US005259979A

United States Patent [19]

Condra et al.

[11] Patent Number: 5,259,979

[45] Date of Patent: Nov. 9, 1993

[54] PROCESS FOR REGENERATION OF CLEANING COMPOUNDS

[75] Inventors: Richard C. Condra, Highland Village; Paul C. Healey, Dallas, both of Tex.

[73] Assignee: Oliver Sales Company, Dallas, Tex.

[21] Appl. No.: 3,570

[22] Filed: Jan. 13, 1993

[51] Int. Cl.[5] ..... C09K 13/04; B44C 1/22; C23F 1/00

[52] U.S. Cl. ..... 252/79.2; 134/3; 134/10; 156/626; 156/642; 156/666

[58] Field of Search ..... 252/79.1, 79.2, 79.4, 252/142; 156/626, 627, 642, 666; 134/3, 10, 41

[56] References Cited

U.S. PATENT DOCUMENTS

| | | | |
|---|---|---|---|
| 3,532,568 | 10/1970 | Kovell et al. | 156/642 |
| 3,880,685 | 4/1975 | Rehm et al. | 156/642 |
| 3,964,956 | 6/1976 | Snyder | 156/345 |
| 4,233,106 | 11/1980 | Goffredo | 156/627 |
| 4,747,907 | 5/1988 | Acocella et al. | 156/642 |
| 5,188,703 | 2/1993 | Greenberg | 156/642 |

*Primary Examiner*—William A. Powell
*Attorney, Agent, or Firm*—Larry B. Dwight

[57] ABSTRACT

This invention is a process to rejuvenate the depleted metal salt oxidizing agents in used microetch cleaning compositions and to maintain the desired etch rate. This process comprises the steps of: (1) measuring the reduced metal salt oxidizing agent in the microetch cleaning composition, (2) adding a rejuvenating agent in a stoichiometric or sub-stoichiometric quantity, and (3) mixing and allowing the rejuvenating agent to react with the reduced metal salt oxidizing agent to restore the concentration of the metal salt oxidizing agent to its approximate concentration in the original microetch cleaning composition.

24 Claims, No Drawings

PROCESS FOR REGENERATION OF CLEANING COMPOUNDS

BACKGROUND OF THE INVENTION

This invention relates to the regeneration of solutions of microetch cleaning compositions used to remove oxidation, fingerprints, and surface contaminants from copper, copper alloys and other metallic surfaces.

Industrial cleaning compositions used to clean metallic surfaces prior to electroplating, molten metal coating and other manufacturing operations often rely on the removal of a thin layer of metal from the surface being cleaned to assure that all the contaminants are removed from the surface. These types of cleaners are often referred to in the industry as microetch cleaners. The composition of microetch cleaners varies widely depending on what type of metal is to be cleaned and microetched. The cleaning composition must be able to dissolve the metal to be cleaned. For example, a cleaning composition designated to function as a microetch cleaner for aluminum must be able to dissolve a thin layer of the aluminum surface being cleaned. A cleaning composition that will microetch the surface of one metal may not microetch the surface of a different metal. In the example of an aluminum microetch cleaner, the cleaning composition might be a dilute aqueous solution of an alkali hydroxide such as sodium hydroxide. Whereas such a cleaning composition is effective as a microetch cleaner for aluminum, it is totally ineffective as a microetch cleaner for most ferrous alloys such as low carbon steel because it will not dissolve low carbon steel.

In most cases the surface layer of metal dissolved by microetch cleaners is limited to about 1,000 microinches (millionths of an inch) or less. This is one reason that cleaning compositions of this type are called microetch cleaners. The amount of metal dissolved by the microetch cleaner is controlled by choice of the metal dissolving agent used in the cleaning composition, the concentration of the metal dissolving agent, the time the metallic surface is exposed to the cleaning composition, the temperature of the cleaning composition, spray pressure and nozzle configuration (if the cleaning composition is sprayed onto the metallic surface), and other conditions of the cleaning composition and application method of the cleaning composition. Most often the etch rate is about 100 microinches per minute or less.

Although metal etching agents used in microetch cleaners may be the same or similar to agents commonly used to dissolve gross quantities of metals, a clear distinction must be made between solutions designed to dissolve all or substantially all of a metal part and a microetch cleaning process in which 1,000 microinches or less of surface metal is removed in the cleaning process. The objective of a gross metal dissolving solution is to dissolve all or essentially all of the metal exposed to the dissolving solution. The objective of a microetch cleaning composition is to remove surface contaminants and expose a fresh layer of virgin metal on the surface of the part in preparation for subsequent manufacturing operations. Two examples of subsequent manufacturing operations which typically follow microetch cleaning are: electroplating and application of molten metal deposits onto the microetch cleaned surface.

The compositions of microetch cleaners are typically different from gross metal dissolving solutions in the respect that they are lower in concentration of metal dissolving agents than gross metal dissolving solutions.

In order to keep the metal removal rate within the microetch range, fairly low concentrations of metal dissolving agents are used in the cleaning composition. Because microetch cleaning compositions typically have rather low concentrations of metal dissolving agents, they often have a limited useful life. The rather low concentration of metal dissolving agents is often depleted before the other constituents of the cleaning composition are depleted. Thus it is desirable to be able to regenerate or rejuvenate the metal dissolving agent in the cleaning composition. This invention discloses a process for rejuvenation or regeneration of one type of microetch cleaning composition.

Microetch cleaning compositions used to remove fingerprints, oxidation and miscellaneous soils from copper and copper alloys are well known to the industry. The cleaning compositions are usually aqueous solutions containing an oxidizing agent such as ferric ions, cupric ions or dichromate ions; a pH control agent, such as a non-oxidizing acid like sulfuric acid or hydrochloric acid, or an acidic salt of a strong acid and a weak base, such as ferric chloride or cupric chloride; and, optionally, surfactants, water soluble solvents and corrosion inhibitors.

One of the functions performed by the ingredients in the cleaning composition is pH control. The acid or the acidic salt of a strong acid and a weak base dissolve oxidation from the surface of the parts to be cleaned. The oxides of copper and oxides of alloying metals are soluble in many acidic aqueous solutions. The pH control agents keep the aqueous solutions strongly acidic enough to dissolve the oxides from the surface. Little if any of the unoxidized metal underlying the oxide film is dissolved by the acidic solution. After the initial oxide film has been dissolved into the acidic solution, there is no further dissolution of unoxidized metal. Thus, an aqueous solution of a non-oxidizing acid does not function as a microetch.

Another function performed by the ingredients of the microetch cleaning composition is oxidation. The oxidizing agent is believed to oxidize the surface of the copper metal so that the oxides of copper formed by the oxidizing agent can be dissolved by the acidic, aqueous solution of pH control agent. An oxidizing agent alone provides little or no microetching of a copper surface when no pH control agent is present to dissolve the oxidized copper from the surface. The basis metal is microetched by the co-operative action of the oxidizing agent and the acidic aqueous solution of pH control agent. In some cases a single chemical compound can provide both pH control and oxidizing properties. Examples of such compounds are cupric chloride, ferric sulfate, and ceric perchlorate.

Often the oxidizing agent is the higher oxidation state cation of a metal which can exist in more that one cationic oxidation state. In the examples above, ferric ($Fe^{+3}$) cupric ($Cu^{+2}$), and ceric ($Ce^{+4}$) ions are the higher oxidation state cations. Ferrous ($Fe^{+2}$), cuprous ($Cu^{+}$), and cerous ($Ce^{+2}$) are the corresponding lower oxidation state cations.

In some cases the oxidizing agent is the higher oxidation state anion of a complex metal ion which can also exist as a lower oxidation state anion or cation. Examples of this type oxidizing agent are the dichromate anion ($Cr_2O_7^{-2}$) in which the chromium exists in the +6 oxidation state and permangante anion ($MnO_4^{-1}$) in which the manganese exists in the +7 oxidation state. Corresponding lower oxidation state ions are chromic cation ($Cr^{+3}$), in which the chromium exists in the +3 oxidation state, and the tetravalent manganese cation ($Mn^{+4}$) with its +4 oxidation state.

Other ingredients used in microetch cleaning compositions may include surfactants, water soluble solvents and corrosion inhibitors. The presence of these ingredients in microetch cleaning compositions varies widely. Most microetch cleaning compositions contain surfactants to emulsify and lift oily soils off the metallic surfaces to be cleaned. Some cleaning compositions contain water soluble solvents such as lower molecular weight alcohols and/or glycols or glycol ethers. These often function as solvents for oily soils to be removed from the surfaces to be cleaned. Corrosion inhibitors are sometimes included in the cleaning composition. They provide protection for metals which may be exposed to the cleaning composition but which are not to be microetched. They may also provide resistance to tarnishing of the microetch cleaned metal surface after the cleaning process is completed. Examples of such corrosion inhibitors for copper and copper alloys are mercaptobenzothiazole and benzotriazole.

When the cleaning compositions are used to clean and microetch copper surfaces, the oxidizing agent is often depleted well before the other ingredients in the cleaning composition are depleted. It is economically advantageous to regenerate or rejuvenate the oxidizing agent so the performance of the cleaning composition can be restored without replacing the entire cleaning composition. Since many cleaning compositions used in industrial settings are dilute aqueous solutions of concentrated proprietary blends of the active ingredients, one traditional method to restore the performance of the cleaning composition is to simply add more proprietary concentrate to the cleaning composition. This replaces the depleted oxidizing ingredient in the cleaning composition. However, this has the disadvantage of adding more of all the other active ingredients to the cleaning compositions at the same time the replacement oxidizing agent is added. This method is less costly than replacing the entire cleaning composition, but it introduces some excess cost because of the addition of active ingredients that have not been depleted. Furthermore, since the oxidizing agent is often a metal salt which forms a water insoluble hydroxide during precipitation methods of waste treatment of spent solutions of the cleaning compositions, additions of concentrated proprietary blends increases the sludge generated during waste treatment. The spent solutions of the cleaning composition usually contain hazardous heavy metal ions. During precipitation waste treatment, these ions co-precipitate along with metal hydroxides from the oxidizing agent. The hazardous heavy metal sludge and the metal hydroxide sludge from the oxidizing agent are inseparable. Under current environmental regulations, mixtures of non-hazardous metal hydroxide sludge and hazardous heavy metal sludge are classified as hazardous. Thus, the total volume of hazardous waste sludge that must be disposed of increases substantially. The cost of disposal of hazardous sludges increases proportionally.

In other waste treatment techniques, such as ion exchange or electrowinning, the presence of excessive metal salt oxidizing agents contributes excessive costs to the waste treatment of spent microetch cleaning compositions. Excessive metal ions block exchange sites on ion exchange resins. The metal ions from the oxidizing agent attach to exchange sites on the resin where heavy metal ions would normally attach. This results in the need for more frequent regeneration of the ion exchange resin and excessive costs.

Excessive oxidizing agents interfere with electrowinning methods of waste treatment by consumption of excessive electricity during the electroplating operation. This occurs because the oxidizing agent must be reduced before the heavy metals in the spent solution can be electrowon. Additionally some of the oxidizing agents, notably ferric ions, often adversely affect the quality of the electroplated deposit formed in the electrowinning process. Rather than forming a dense, adherent deposit on the cathode of the electrowinning cell, ferric ions often cause the deposit to be loose and porous. This often makes the removal of the electroplated deposit from the electrowinning cell difficult.

Another traditional method to restore the performance of microetch cleaning compositions in which the oxidizing agent has been depleted is to simply add more oxidizing agent to the cleaning composition. Whereas this approach is less costly than adding concentrated proprietary blends as outlined above, the introduction of additional metal ion type oxidizing agent exacerbates all the problems with waste treatment previously discussed.

SUMMARY OF INVENTION

This invention is a process to rejuvenate the depleted metal salt oxidizing agents in used microetch cleaning compositions and to maintain the desired etch rate. This process comprises the steps of: (1) measuring the reduced metal salt oxidizing agent in the microetch cleaning composition, (2) adding a rejuvenating agent in a stoichiometric or sub-stoichiometric quantity, and (3) mixing and allowing the rejuvenating agent to react with the reduced metal salt oxidizing agent to restore the concentration of the metal salt oxidizing agent to its approximate concentration in the original microetch cleaning composition.

This invention overcomes the disadvantages of: (1) a short useful life of microetch cleaning composition due to depletion of oxidizing agent, (2) the excessive cost of replacement of non-depleted ingredients in the cleaning composition when the entire cleaning composition is replaced, (3) the excessive cost and/or interference with waste treating of spent microetch cleaning composition when proprietary concentrated blends are added to replace depleted oxidizing agents, and (4) excessive cost and/or interference with waste treating of spent microetch cleaning compositions when additional metal salt oxidizing agent is added to the cleaning composition to replace depleted oxidizing agent.

The primary objective of this invention is to prolong the useful life of the microetch cleaning composition in the microetching process.

Another objective of this invention is to reduce the blocking of exchange sites on ion exchange resins used in waste treatment.

Another objective of this invention is to reduce formation of sludge during precipitation methods of waste treatment.

A still further object of the invention is to provide an economical method of rejuvenating the metal salt oxidizing agent in a microetch cleaning composition to reduce the harm to the environment.

A still further object of the invention is to regenerate or rejuvenate the cleaning performance of microetch cleaning composition which have been used until the cleaning performance is no longer acceptable.

Another object of the invention is to regenerate or rejuvenate the microetching performance of microetch cleaning compositions that have been used until the microetching performance is no longer acceptable.

Another object of the invention is to increase the amount of metal that may be dissolved into microetch cleaning compositions by enabling the pH adjusting ingredients to be used more fully.

A still further object of the invention is to reduce the frequency with which the microetch cleaning composition must be discarded and recharged.

A still further object of the invention is to reduce the total amount of spent microetch cleaning composition that must be discarded and recharged.

A still further object of the invention is to reduce the total amount of spent microetch cleaning composition that must be waste treated and reduce the total amount of metal bearing sludge generated by precipitation methods of waste treatment of spent microetch cleaning compositions.

A still further object of the invention is to reduce the total amount of of metal ions exchanged onto ion exchange resins used for ion exchange methods of waste treatment of spent microetch cleaning compositions.

A still further object of the invention is to minimize the total cost to operate microetch cleaning compositions.

Another object of the invention is to reduce interference with electrowinning methods of waste treatment.

Other and further objects of the invention will become more apparent upon a detailed study of the hereinafter following detailed description of the invention.

DETAILED DESCRIPTION OF INVENTION

This invention is a process to rejuvenate a used microetch cleaning composition having an etch rate of less than 1000 micro inches per minute. The types of microetch cleaning compositions amenable to this process have a metal salt oxidizing agent and a pH control agent in an aqueous solution. They may also contain surfactants, water soluble solvents and/or corrosion inhibitors. The process includes the steps of: (1) measuring the depleted metal salt oxidizing agent, (2) adding a rejuvenating agent in a stoichiometric or sub-stoichiometric quantity, and (3) mixing and allowing the rejuvenating agent to react with the reduced metal salt oxidizing agent to restore the concentration of metal salt oxidizing agent to the approximate level in the original solution.

It is believed that the depletion of metal salt oxidizing agent in a microetch cleaning composition occurs because the metal salt oxidizing agent is chemically reduced from a higher oxidation state to a lower oxidation state during its reaction with the metallic surface that is cleaned and microetched. For example, when ferric ions ($Fe^{+3}$) react with copper surfaces during the microetch cleaning process, they are chemically reduced to ferrous ions ($Fe^{+2}$). Ferrous ions are ineffective in continued reaction with copper surfaces, so the microetch cleaning process stops.

The chemical reduction of metal salt oxidizing agents is a reversible reaction. It has been discovered that if an oxidizing agent of sufficient strength is reacted under the proper conditions with the reduced metal salt oxidizing agent, the reduced metal salt oxidizing agent will be reoxidized or rejuvenated. The reoxidized metal salt oxidizing agent is then available again to react with metallic surfaces to be cleaned and microetched. In the previous example of ferric ions reacting with a copper surface and being reduced to ferrous ions, the ferrous ions can be reacted with a suitable oxidizing agent so that they are reoxidized to ferric ions. The reoxidized ferric ions are then available to react with more copper surface.

The first step of the process is to measure or analyze the depleted metal salt oxidizing agent. The analysis may be done by determining the quantity of the depleted oxidizing agent in the microetch cleaning composition by use of a suitable titration method, colorametric procedures, specific ion measurement, or ion chromatography. The analysis may be done indirectly by using oxidation reduction potential (ORP) methods.

The rejuvenating agents that will satisfactorily reoxidize reduced metal salt oxidizing agents must meet the following requirements:

1. They must be of sufficient oxidizing power to react with the reduced metal salt oxidizing agent to raise it from its chemically reduced lower oxidation state to its original higher oxidation state.
2. They must not form insoluble hydroxides which contribute to the total volume of sludge generated during precipitation methods of waste treatment.
3. They must not contribute appreciably to the blocking of exchange sites on ion exchange resins used for removal of heavy metal ions from waste water.
4. They must be used in low enough concentration so that the microetch cleaning composition is not appreciably diluted by their addition.
5. They must not introduce any material that will adversely affect the cleaning or microetching properties of the microetch cleaning composition.
6. They must not introduce any material that will cause the microetch cleaning composition to be more hazardous or toxic. Neither can they react with the microetch cleaning composition to form any material that causes the cleaning composition to become more hazardous or toxic.
7. They must be of equal cost or less costly than replacement of the entire spent microetch cleaning composition.
8. The reaction between the reduced metal salt oxidizing agent and the added oxidizing agent must not be so vigorous that the rejuvenation or regeneration process presents a health or safety hazard to workers performing the regeneration or rejuvenation process.
9. The reoxidation of the reduced metal salt oxidizing agent must be measurable and controllable.

The preferred rejuvenating agents consist of peroxygen compounds but other agents may include oxygen, halogens or complex halogen compounds.

Peroxygen compounds are generally the preferred class of oxidizing agents in the practice of this process. Hydrogen peroxide, sodium peroxide, sodium perborate, potassium monopersulfate, sodium peroxydisulfate, potassium peroxide, potassium perborate, sodium monopersulfate, potassium peroxydisulfate, ammonium peroxydisulfate and ammonium monopersulfate are examples of this type of compound. These compounds oxidize well, do not form insoluble hydroxides, contribute little to ion exchange site blockage, are effective at low concentrations, do not interfere with cleaning or microetching, do not make the microetch cleaning composition more toxic or hazardous, are economical to use, are not excessively vigorous in their reaction, and are easily controllable and measurable.

The least costly source of oxidizing agent that was discovered to meet the requirements of this process is oxygen. If air is bubbled or sparged through used microetch cleaning compositions with reduced metal salt oxidizing agents or if the microetch cleaning composition with reduced metal salt oxidizing agents is sprayed into the air, the reduced metal salt oxidizing agent is reoxidized by oxygen in the air to its initial higher oxidation state. Use of oxygen is particularly suitable for use with ferric ions that have been reduced to ferrous ions. Use of oxygen supplied by air sparging the microetch cleaning composition or spraying the microetch cleaning composition into the air is often limited to those compositions that contain only non-foaming or low foaming ingredients. Use of air sparging or spraying has limited application with cleaning compositions containing foaming surfactants.

Chlorine, bromine or iodine can be used to reoxidize reduced metal salt oxidizing agents. But because of their toxic properties, they are difficult to handle safely and thus are of limited use.

Complex halogen ions such as bromates, chlorates, chlorites, hypochlorites, iodates, may also be used as rejuvenating agents. However, these introduce undesirable reaction products not in the original microetch cleaning solution, the rate of reaction is sometimes too violent, and they are hazardous to handle.

In the second step it is important that the rejuvenating agent be added to the used microetch cleaning composition with reduced metal salt oxidizing agent in stoichiometric or sub-stoichiometric quantities with respect to the reduced metal salt oxidizing agent. This means that after reaction with the reduced metal salt oxidizing agent, none of the added rejuvenating agent remains in the microetch cleaning composition. This is important to maintain the etch rate at the desired level. This is also important because the surface conditions obtained using a microetch cleaning composition with one type oxidizing agent are often different from those obtained using a microetch cleaning composition with a different type oxidizing agent. Differences in surface condition when using different oxidizers may include: differences in reflectivity of the surface, differences in receptivity to various treatments applied after microetch cleaning, and differences in microscopic structure of the metallic surface. Since differences in surface conditions may adversely affect subsequent processing, the rejuvenated or regenerated cleaning composition should be identical to or as nearly identical as possible to the original microetch cleaning composition. Therefore, residues of excess unreacted oxidizing agent used to reoxidize the reduced metal salt oxidizing agent are to be avoided.

The third step is to mix the rejuvenating agent with the microetch cleaning composition to homogeneously distribute the rejuvenating agent throughout the microetch cleaning composition. This allows the rejuvenating agent to fully react with the depleted metal salt oxidizing agent in the microetch cleaning composition. This rejuvenates the depleted metal salt oxidizing agent and restores the microetch cleaning composition to the desired etch rate.

Examples of how the process is practiced:

EXAMPLE 1

A microetch cleaning composition containing hydrochloric acid, ferric ions supplied by ferric chloride, and a non ionic wetting agent is used to perform microetch cleaning of copper surfaces until the desired degree of microetch is no longer obtained. The first step is to measure the concentration of ferric ions that have been reduced to ferrous ions by titration of the ferrous ions with a standard solution of ceric ions using ferroin indicator. This is also known as an oxidation-reduction titration. The second step is to add a stoichiometric or sub-stoichiometric quantity of hydrogen peroxide slowly to the cleaning composition with vigorous stirring. The hydrogen peroxide oxidizes the ferrous ions back to ferric ions. This results in a rejuvenated or regenerated microetch cleaning composition that is then available to perform microetch cleaning of additional copper surfaces.

EXAMPLE 2

A microetch cleaning composition containing sulfuric acid and cupric ions is used to perform microetch cleaning of copper surfaces until the desired degree of microetch is no longer obtained. The first step is to measure the concentration of cupric ions that have not been reduced to cuprous ions by titration with standard thiosulfate solution using potassium iodide and starch indicator. This is also known as an oxidation-reduction titration. The second step is to add stoichiometric or sub-stoichiometric quantity of potassium monopersulfate to the cleaning composition with vigorous stirring. The potassium monopersulfate reoxidizes the cuprous ions back to cupric ions. The rejuvenated or regenerated microetch cleaning composition is then available to perform microetch cleaning of additional copper surfaces.

EXAMPLE 3

A microetch cleaning composition containing potassium dichromate and sulfuric acid is standardized against a millivolt meter using an oxidation reduction potential (ORP) electrode and a standard reference electrode(SRE). The microetch cleaning composition is used to perform microetch cleaning of copper surfaces until the desired degree of microetch is no longer obtained. Hydrogen peroxide is slowly added with vigorous stirring until the millivolt reading from the ORP/SRE electrode pair is restored to approximately the same potential as the original millivolt reading obtained from the unused microetch cleaning composition. The hydrogen peroxide reoxidizes the trivalent oxidation state chromic ions ($Cr^{+3}$) back to hexavalent oxidation state dichromate ions ($Cr_2O_7^{-2}$). The rejuvenated or regenerated microetch cleaning composition is then available to perform microetch cleaning of additional copper surfaces.

EXAMPLE 4

A microetch cleaning composition containing potassium dichromate and sulfuric acid similar to that in the previous example is standardized against a millivolt meter using a oxidation reduction potential (ORP) electrode and a standard reference electrode (SRE). The microetch cleaning composition is used to perform microetch cleaning of copper surfaces. Millivolt readings from ORP/SRE electrode pair are monitored continuously until the microetch cleaning performance of the microetch cleaning composition drops to an unacceptable level. At that point a millivolt reading obtained while the cleaning composition was cleaning and microetching satisfactorily is selected as the lower control limit for automatic chemical dispensing equipment. The original millivolt reading is used as the upper control limit for the chemical dispensing equipment. When the voltage falls to the set lower control level a suitable control circuit is used to energize automatic chemical dispensing equipment, such as a metering pump. The dispensing equipment begins to dispense or add hydrogen peroxide to the microetch cleaning composition with vigorous stirring. The control circuit disengages the metering pump when the original voltage from the ORP/SRE has been restored. The hydrogen peroxide reoxidizes the trivalent oxidation state chromic ions ($Cr^{+3}$) back to hexavalent oxidation state dichromate ions ($Cr_2O_7^{-2}$). The rejuvenated or regenerated cleaning composition is available to perform microetch cleaning on additional copper surfaces. Additionally, the cleaning composition is constantly kept in satisfactory operating condition by the automatic additions of hydrogen peroxide.

We claim:

1. A process to rejuvenate a used microetch cleaning composition used for microetch cleaning a basis metal surface wherein the etch rate is to be maintained in a predetermined range less than 1,000 microinches per minute comprising the steps of:

(a) analyzing the microetch cleaning composition to determine the depleted constituents in the microetch cleaning composition;

(b) adding a rejuvenating agent in a stoichiometric or sub-stoichiometric quantity with respect to the depleted constituents used in the microetch cleaning composition; and (c) mixing the microetch cleaning composition with the rejuvenating agent and allowing the rejuvenating agent to fully react with the microetch cleaning composition.

2. The process called for in claim 1 wherein the microetch cleaning composition comprises: a metal salt oxidizing agent and a pH control agent in an aqueous solution.

3. The process called for in claim 1 wherein the rejuvenating agent is an oxidizing agent chosen from one of the following: peroxygen compounds, oxygen, halogens, or complex halogen ions.

4. The process called for in claim 1 wherein the depleted constituent analyzed for comprises a metal salt oxidizing agent.

5. The process called for in claim 1 wherein the step of analyzing comprises: analyzing for the amount of depleted metal salt oxidizing agent.

6. The process called for in claim 5 wherein the step of analyzing for depleted metal salt oxidizing agent comprises analysis by titration reduction.

7. The process called for in claim 5 wherein the step of analyzing comprises: analyzing for the amount of depleted metal salt oxidizing agent by colorametric procedures.

8. The process called for in claim 5 wherein the step of analyzing comprises: analyzing for the amount of depleted metal salt oxidizing agent by specific ion measurement procedure.

9. The process called for in claim 5 wherein the step of analyzing comprises analyzing for the amount of depleted metal salt oxidizing agent by ion chromatography.

10. A process to rejuvenate the depleted metal salt oxidizing agent in a used microetch cleaning composition for cleaning a basis metal surface wherein the etch rate is to be maintained in a predetermined range of less than 1000 microinches per minute comprising the steps of:

(a) analyzing the depleted metal salt oxidizing agent in the microetch cleaning composition; and (b) adding a rejuvenating agent in a stoichiometric or sub-stoichiometric quantity to react with the depleted metal salt oxidizing agent to restore the concentration of the metal salt oxidizing agent to the approximate original concentration in the microetch cleaning composition; and (c) mixing the microetch cleaning composition with the rejuvenating agent and allowing the rejuvenating agent to fully react with the microetch cleaning composition.

11. The process called for in claim 10 wherein the microetch cleaning composition comprises: a metal ion salt oxidizing agent and a pH control agent in an aqueous solution.

12. The process called for in claim 10 wherein the rejuvenating agent is an oxidizing agent chosen from one of the following substances: peroxygen compound, oxygen, halogen, or a complex halogen ion.

13. The process called for in claim 10 wherein the step of analyzing comprises: analyzing for the amount of depleted metal salt oxidizing agent by oxidization-reduction titration.

14. The process called for in claim 10 wherein the step of analyzing comprises: analyzing for the amount of depleted metal salt oxidizing agent by colorametric procedures.

15. The process called for in claim 10 wherein the step of analyzing comprises: analyzing for the amount of depleted metal salt oxidizing agent by specific ion measurement procedure.

16. The process called for in claim 10 wherein the step of analyzing comprises: analyzing for the amount of depleted metal salt oxidizing agent by ion chromatography.

17. A process to rejuvenate a microetch cleaning composition which comprises a metal salt oxidizing agent and pH control agent in an aqueous cleaning composition and having an etch rate of less than 1,000 microinches per minute comprising the steps of: (a) analyzing for the amount of depleted metal salt oxidizing agent; (b) adding a rejuvenating agent in stoichiometric or sub-stoichiometric quantity to the micro etch cleaning composition; and (c) mixing the microetch cleaning composition with the rejuvenating agent and allowing the rejuvenating agent to react with the depleted metal ion salt oxidizing agent.

18. The process called for in claim 17 wherein the rejuvenating agent comprises a peroxygen compound.

19. The process called for in claim 17 wherein the rejuvenating agent comprises oxygen.

20. A process to rejuvenate a used microetch cleaning composition comprising a ferric compound and an acid having an etch rate of less than 1,000 micro inches per minute comprising the steps of (a) analyzing for the quantity of depleted ferric ions; (b) adding a peroxygen compound in stoichiometric or sub-stoichiometric quantity with respect to the depleted ferric ions to the microetch cleaning composition; and (c) mixing the microetch cleaning composition with the peroxygen compound and allowing the peroxygen compound to fully react with the depleted ferric ions.

21. The process called for in claim 20 wherein peroxygen compound is chosen from a group which includes hydrogen peroxide, sodium peroxide, sodium perborate, potassium monopersulfate, sodium peroxydisulfate, potassium peroxide, potassium perborate, sodium monopersulfate, potassium peroxydisulfate, ammonium peroxydisulfate and ammonium monopersulfate.

22. The process called for in claim 20 wherein the peroxygen compound is hydrogen peroxide.

23. The process called for in claim 17 wherein the rejuvenating agent is a hologen.

24. The process called for in claim 17 wherein the rejuvenating agent is a complex hologen compound.

* * * * *